US007267594B2

(12) United States Patent
Fuse et al.

(10) Patent No.: US 7,267,594 B2
(45) Date of Patent: Sep. 11, 2007

(54) JET PUMP MOUNTING STRUCTURE OF SMALL-SIZED BOAT

(75) Inventors: Tomohiro Fuse, Wako (JP); Hiroshi Iwakami, Wako (JP); Takayoshi Miura, Wako (JP)

(73) Assignee: Honda Motor Co., Ltd., Minato-ku (JP)

( * ) Notice: Subject to any disclaimer, the term of this patent is extended or adjusted under 35 U.S.C. 154(b) by 0 days.

(21) Appl. No.: 11/369,472

(22) Filed: Mar. 7, 2006

(65) Prior Publication Data

US 2006/0205295 A1 Sep. 14, 2006

(30) Foreign Application Priority Data

Mar. 14, 2005 (JP) ..... 2005-071525

(51) Int. Cl.
*B63H 21/30* (2006.01)

(52) U.S. Cl. ..... 440/111; 440/38

(58) Field of Classification Search ..... 440/38, 440/111, 112

See application file for complete search history.

(56) References Cited

U.S. PATENT DOCUMENTS 6,062,922 A * 5/2000 Nanami ..... 440/38
6,739,923 B2 * 5/2004 Murakami ..... 440/111
2003/0064638 A1 * 4/2003 Fuse et al. ..... 440/38

FOREIGN PATENT DOCUMENTS

JP 2003-89395 3/2003

* cited by examiner

*Primary Examiner*—Ed Swinehart
(74) *Attorney, Agent, or Firm*—Hamre, Schumann, Mueller & Larson P.C.

(57) ABSTRACT

Jet pump mounting structure of a small-sized boat including a front face of a thrust plate attached to a rear face of a front wall of a pump case, and a jet pump attached to a rear face of the thrust plate. The jet pump is arranged in the pump case. The front wall is formed at an up grade toward the rear of the hull, the front face of the thrust plate is formed at an up grade so that the front face is parallel to the front wall, and the rear face of the thrust plate is formed in parallel with a plane perpendicular to the axis of the jet pump.

2 Claims, 6 Drawing Sheets

JET PUMP MOUNTING STRUCTURE OF SMALL-SIZED BOAT

FIELD

The present invention relates to jet pump mounting structure of a small-sized boat where a pump case is provided to the rear of a hull and a jet pump is attached to a front wall of the pump case via a thrust plate.

BACKGROUND

A small-sized boat is known where a lower part of the body is formed by a hull, an upper part of the body is formed by a deck, a jet pump is attached to the rear of the hull and water is sucked from a suction opening at the bottom of the body by driving the jet pump by an engine and which is glided by jetting the sucked water backward.

JP-A No. 89395/2003 discloses a jet pump mounting structure of a small-sized boat where a pump case is provided to the rear of a hull, a thrust plate is provided to a front wall of the pump case and a jet pump is provided to the thrust plate.

In the jet pump mounting structure of the small-sized boat, the jet pump is held in a desired position by providing the thrust plate to the front wall of the pump case and providing the jet pump to the thrust plate, water is jetted from a nozzle of the jet pump, and the jetted water is used as the driving force.

A hull and a deck forming the body are made of resin and are normally molded by injection molding.

FIG. 6 is an explanatory drawing for explaining a process in which a hull of a conventional type small-sized boat is molded.

A fixed mold 101 and a movable mold 102 of a mold 100 are clamped and a cavity 103 is formed. Melted resin 105 is supplied into the cavity 103 via an injection passage 104 from a direction shown by an arrow "a". The melted resin 105 in the cavity 103 is solidified to form the hull 106. The movable mold 102 is moved in a direction shown by an arrow "b", the mold 100 is opened, and the hull 106 is released from the opened mold 100.

As for the hull 106, as a front wall 108 of a pump case 107 is substantially vertically formed, no draft angle with the front wall 108 is formed. Therefore, when the hull 106 is released from the mold 100, the hull 106 may not be able to be smoothly released from the mold 100, particularly from the movable mold 102 and it prevents the hull 106 from being easily manufactured.

Therefore, it would be beneficial to provide jet pump mounting structure of a small-sized boat where a jet pump can be mounted in a desired position and the manufacture can be facilitated.

SUMMARY

Jet pump mounting structure of a small-sized boat where a pump case is provided to the rear of a hull forming a lower part of the body, a front face of a thrust plate is attached to a front wall of the pump case, a jet pump is attached to a rear face of the thrust plate, the jet pump is arranged in the pump case, an engine is provided in front of the pump case and the jet pump is driven by the engine. To secure a draft angle when the hull is molded, the front wall is formed at an up grade toward the rear of the hull, the front face of the thrust plate is formed at an up grade so that the front face is parallel to the front wall and the rear face of the thrust plate is formed in parallel with a plane perpendicular to the axis of the jet pump.

The front wall of the pump case is formed at the up grade toward the rear of the hull and the front face of the thrust plate is formed at the up grade so that the front face is parallel to the front wall.

Further, the thrust plate is formed wedgewise by forming the rear face of the thrust plate in parallel with the plane perpendicular to the axis of the jet pump.

Therefore, when the front face of the thrust plate is attached to the front wall formed at the up grade, the rear face of the thrust plate can be arranged in parallel with the plane perpendicular to the axis of the jet pump.

The jet pump can be held in a desired position by attaching the jet pump to the rear face of the thrust plate. Therefore, water jetted from the jet pump can be efficiently used as driving force by holding the jet pump in a desired position.

Further, the front wall of the pump case is formed at the up grade toward the rear of the hull. Therefore, the up grade can be utilized as a draft angle when the hull is molded. Hereby, when the hull is molded, the molded hull can be smoothly released from the mold utilizing the draft angle and the manufacture can be facilitated.

The engine and the jet pump are coupled by a linear propeller shaft, the propeller shaft is inclined at a down grade toward the rear of the hull and the rear face of the thrust plate is formed on a plane perpendicular to the axis of the propeller shaft.

The propeller shaft is inclined at the down grade toward the rear of the body. The rear face of the thrust plate is formed on the plane perpendicular to the axis of the propeller shaft.

The rear face of the thrust plate is formed in parallel with the plane perpendicular to the axis of the jet pump. Hereby, when the jet pump is attached to the rear face of the thrust plate, the axis of the jet pump and the axis of the propeller shaft can be coaxially arranged.

Further, the rear face of the thrust plate can be formed at the up grade toward the rear of the hull by forming the rear face of the thrust plate on the plane perpendicular to the axis of the propeller shaft.

The front face of the thrust plate is formed at the up grade toward the rear of the hull. Therefore, the thickness of the thrust plate can be favorably kept by forming the rear face of the thrust plate at the up grade toward the rear of the hull.

DETAILED DESCRIPTION

Referring to the attached drawings, an embodiment of the invention will be described below. A forward direction, a backward direction, a leftward direction and a rightward direction shall be viewed from a rider, Fr denotes the front side, and Rr denotes the rear side.

Figure 1:
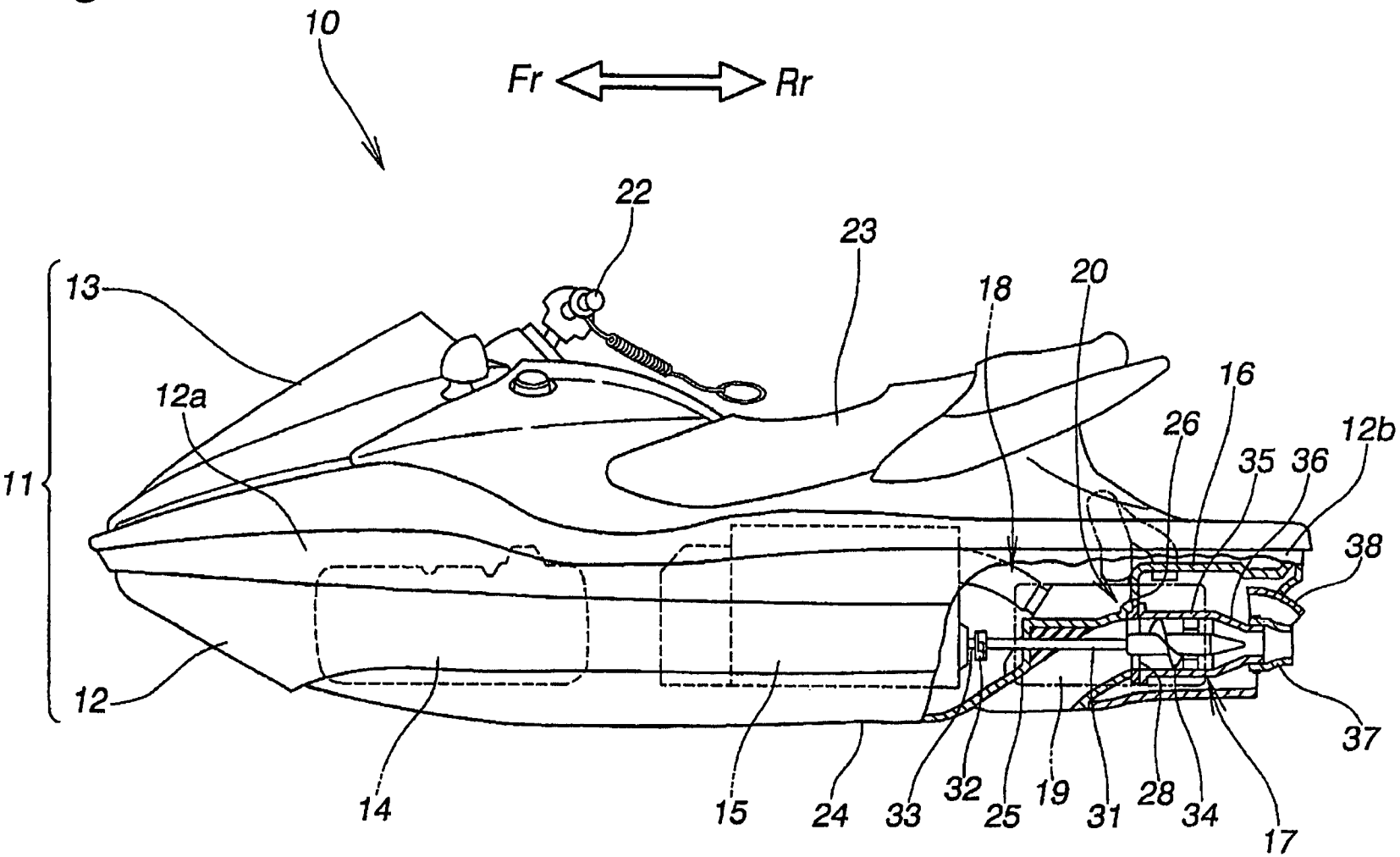
FIG. 1 is a side view showing a small-sized boat provided with jet pump mounting structure according to the invention.

FIG. 1 is a side view showing a small-sized boat provided with jet pump mounting structure according to the invention.

A small-sized boat 10 is a water jet propulsion boat in which a hull 12 forming a lower part of a body 111 is covered with a deck 13 forming an upper part of the body 11. The body 11 is configured by the hull 12 and the deck 13. A fuel tank 14 is provided to the front 12*a* of the hull 12, an engine 15 is provided at the back of the fuel tank 14, a pump case 16 is provided at the back of the engine 15, and a jet pump 17 is provided in the pump case 16 via a jet pump mounting structure 20.

The jet pump 17 is coupled to the engine 15, the inlet side of an exhaust pipe 18 is attached to the engine 15, the exhaust side of the exhaust pipe 18 is placed in the pump case 16, a water muffler 19 is provided on the way of the exhaust pipe 18, steering handlebars 22 are attached over the fuel tank 14, and a seat 23 is attached at the back of the steering handlebar 22.

The hull 12 and the deck 13 are members made of resin and formed by, for example, injection molding.

As for the hull 12, a water introduction passage 25 is formed at the bottom 24 of the boat at the back of the engine 15, is extended to the pump case 16 at an up grade, and a thrust plate 28 is attached to a front wall 26 of the pump case 16. The pump case 16 is formed in the rear 12*b* of the hull 12.

The jet pump 17 is attached to the thrust plate 28. The jet pump 17 is coupled to an output shaft 33 of the engine 15 via a propeller shaft 31 and a coupling joint 32. With the jet pump 17, an impeller 34 is revolved by driving the engine 15 and revolving the propeller shaft 31. When the impeller 34 is revolved, water sucked from the water introduction passage 25 at the bottom 24 is jetted from a steering nozzle 37 to the back of the body 11 via a rear nozzle 36 of a housing 35. Hereby, the small-sized boat 10 is driven forward.

When the small-sized boat 10 is reversed, a reverse bucket 38 over the steering nozzle 37 is moved to a reverse travel position at the back of the steering nozzle 37. Hereby, water jetted backward from the steering nozzle 37 is led toward the front of the body 11 by the reverse bucket 38 and the small-sized boat 10 is reversed by the jetted water.

Figure 2:
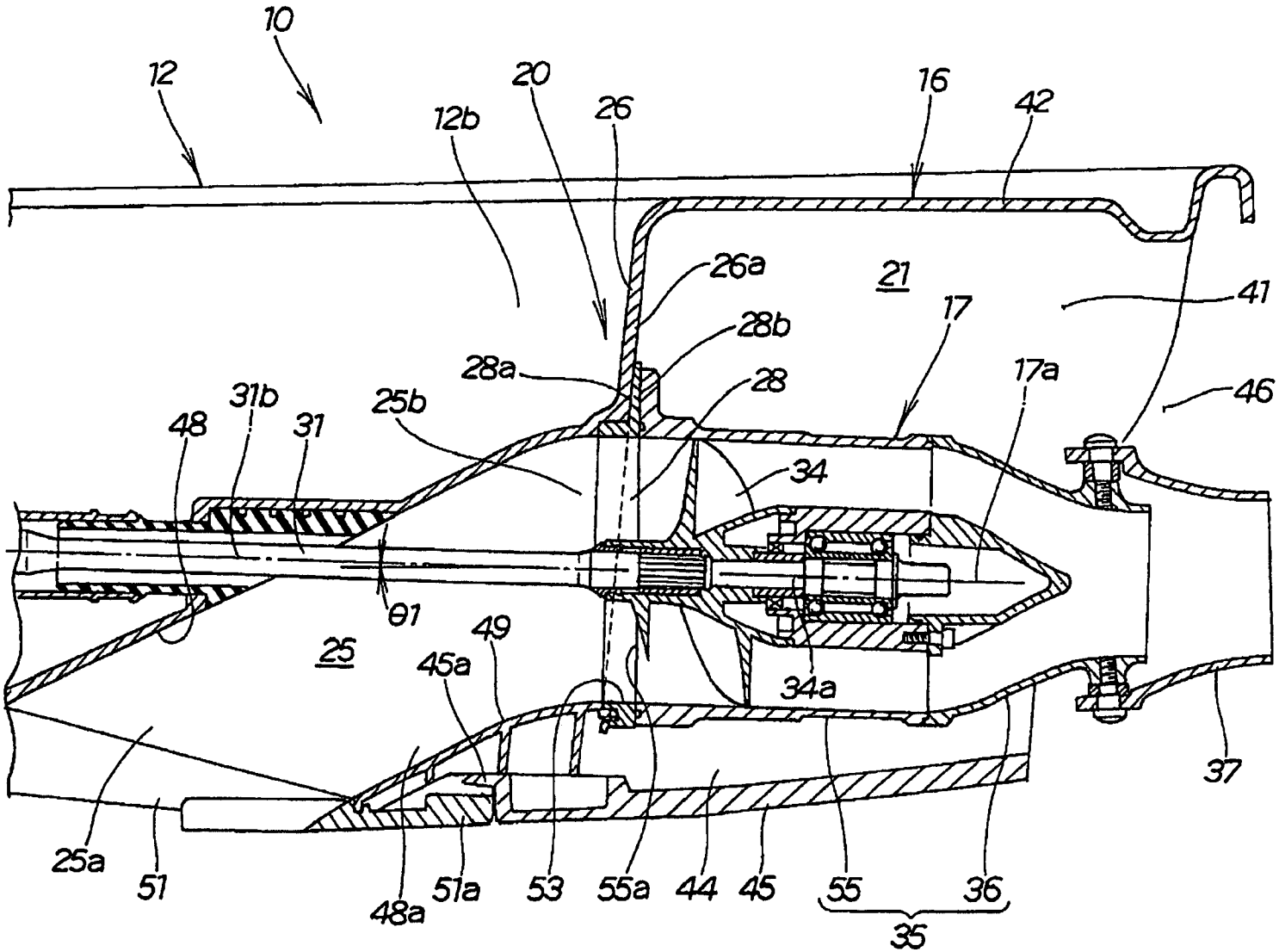
FIG. 2 is a sectional view showing the jet pump mounting structure of the small-sized boat according to the invention.

FIG. 2 is a sectional view showing the jet pump mounting structure of the small-sized boat according to the invention. The jet pump mounting structure 20 of the small-sized boat is provided to the rear 12*b* of the hull 12.

In the jet pump mounting structure 20 of the small-sized boat, the jet pump 17 is arranged in a space 21 in the pump case 16 by attaching a front face 28*a* of the thrust plate 28 to a rear face 26*a* of the front wall 26 of the pump case 16 and attaching the jet pump 17 to a rear face 28*b* of the thrust plate 28.

The front wall 26 of the pump case 16 is extended in a direction of the width of the body 11, a right wall 41 is extended from the right end 26*b* (see FIG. 4) of the front wall 26 toward the rear of the body, a left wall (not shown) is extended from the left end of the front wall 26 toward the rear of the body, a ceiling 42 is provided at respective tops of the front wall 26, the right side wall 41 and the left side wall, and a bottom 44 is closed by a ride plate 45.

The rear 46 of the pump case 16 is open. The rear nozzle 36 and the steering nozzle 37 respectively of the jet pump 17 protrude backward from the open rear 46.

A gate 48 (see FIG. 4, too) is formed in front of the pump case 16 and at the bottom 24 (see FIG. 1) of the boat and the water introduction passage 25 is formed by closing a lower opening 48*a* of the gate 48 by a closing member 49. A grid member 51 is attached to a suction opening 25*a* of the water introduction passage 25 and an exhaust port 25*b* communicates with the inside of the housing 35 via an opening 53 of the thrust plate 28. The front end 45*a* of the ride plate 45 is fitted to the rear end 51*a* of the grid member 51.

The jet pump 17 is provided with the housing 35 attached to the rear face 28*b* of the thrust plate 28. A cylindrical stator 55 of the housing 35 is attached to the rear face 28*b* of the thrust plate 28 and the rear nozzle 36 is provided to the rear of the stator 55.

The impeller 34 is arranged in the stator 55 so that the impeller can be rotated. The impeller 34 is coupled to the output shaft 33 of the engine 15 shown in FIG. 1 via the linear propeller shaft 31 and the coupling joint 32. That is, the engine 15 and the jet pump 17 are coupled by the linear propeller shaft 31 and the coupling joint 32.

The propeller shaft 31 is extended from the coupling joint 32 to the impeller 34 at the back through the front wall 26 and the thrust plate 28. The propeller shaft 31 is inclined at a down grade toward the rear of the hull 12. The down grade of the propeller shaft 31 is equivalent to an angle θ1, shown in FIG. 2. The front face 55*a* of the stator 55 is formed so that the front is substantially perpendicular to the propeller shaft 31.

In the jet pump 17, water is sucked from the suction opening 25*a* into the water introduction passage 25 by driving the engine 15 and rotating the impeller 34. The sucked water is led into the housing 35 through the exhaust port 25*b* of the water introduction passage 25 and the opening 53 of the thrust plate 28. The water led into the housing 35 is fed backward by the impeller 34 and is jetted at the back of the body 11 from the steering nozzle 37 via the rear nozzle 36.

Figure 3:
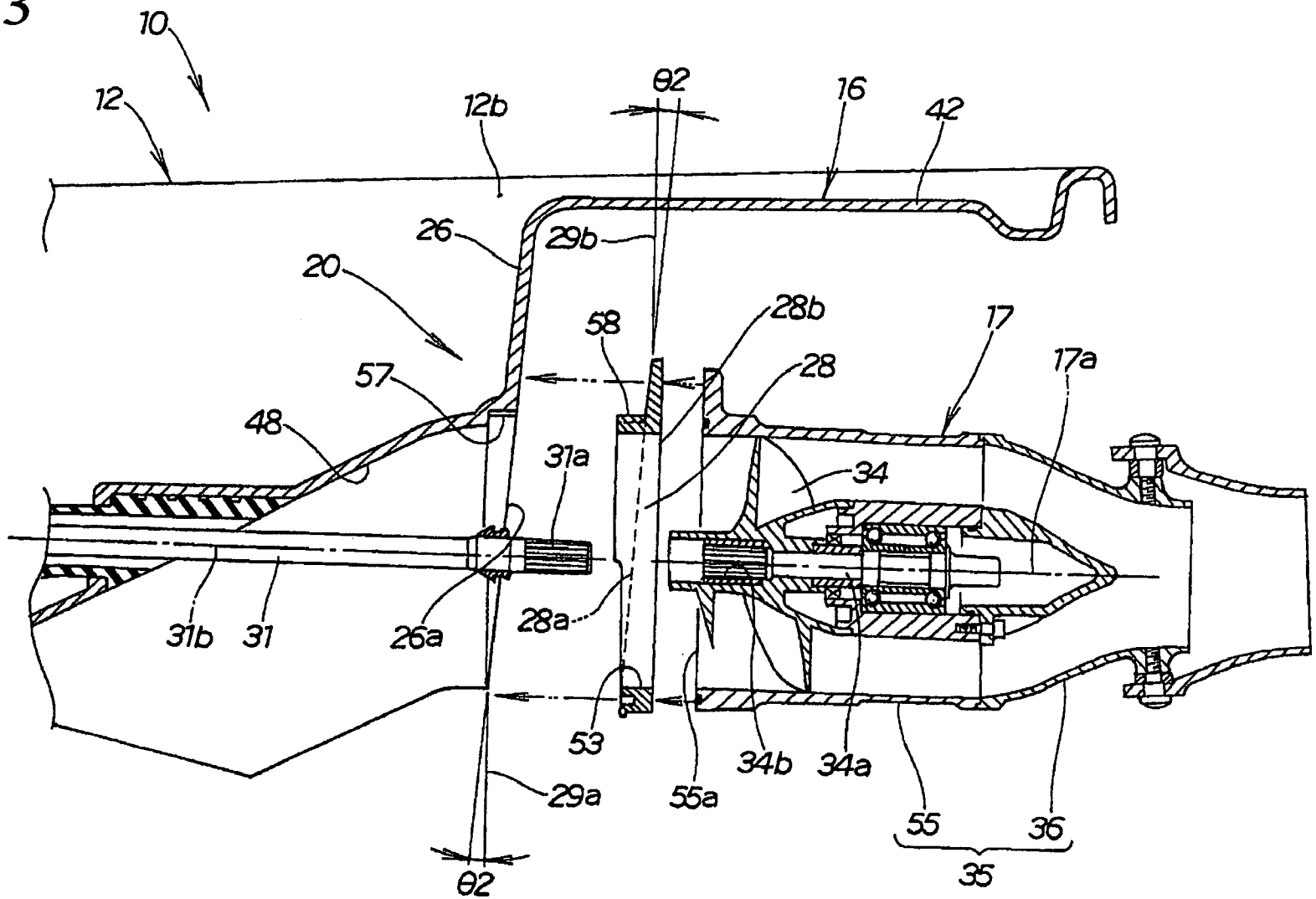
FIG. 3 is an exploded sectional view showing the jet pump mounting structure of the small-sized boat according to the invention.

FIG. 3 is an exploded sectional view showing the jet pump mounting structure of the small-sized boat according to the invention. In the jet pump mounting structure 20 of the small-sized boat, the front wall 26 is formed at an up grade toward the rear of the hull 12 to secure a draft angle θ2 when the hull 12 is molded. The front face 28*a* of the thrust plate 28 is also formed at an up grade so that the front face is parallel to the front wall 26, and the rear face 28*b* of the thrust plate 28 is formed so that the rear face is parallel to a plane perpendicular to the axis 17*a* of the jet pump 17.

As shown in FIG. 3, the front wall 26 is inclined at an angle θ2 with a vertical line 29*a* by forming the front wall 26 at the up grade toward the rear of the hull 12. The angle θ2 is an angle that can be applied as a draft angle of an injection molded product for example. The draft angle when the hull 12 is molded can be secured by inclining the front wall 26 by the angle θ2.

An extended-diameter part 57 is formed slightly larger than the gate 48 on the inclined front wall 26.

The front face 28*a* of the thrust plate 28 is formed at the up grade so that the front face is parallel to the front wall 26. The front face 28*a* is inclined by the angle θ2 with the vertical line 29*b*. The rear face 28*b* of the thrust plate 28 is formed so that the rear face is parallel to the plane perpendicular to the axis 17*a* of the jet pump 17. Further, the rear face 28*b* of the thrust plate 28 is formed on a plane perpendicular to the axis 31*b* of the propeller shaft 31. Therefore, the axis 17*a* of the jet pump 17 can be arranged coaxially with the axis 31*b* of the propeller shaft 31 in a state in which the front face 55*a* of the stator 55 is touched to the rear face 28*b* of the thrust plate 28.

Further, the rear face 28*b* is formed at an up grade toward the rear of the hull 12 by forming the rear face 28*b* of the thrust plate 28 on the plane perpendicular to the axis 31*b* of the propeller shaft 31. The front face 28*a* of the thrust plate 28 is formed at the up grade toward the rear of the hull 12. Therefore, the thickness of the thrust plate 28 is favorably kept by forming the rear face 28*b* of the thrust plate 28 at the up grade toward the rear of the hull 12.

As for the thrust plate 28, a ringed part 58 is protruded from the front face 28*a* toward the front of the body and the opening 53, which is opened to both the front and rear faces 28*a*, 28*b*, is formed in the ringed part 58. The vertical line 29*a* and the vertical line 29*b* are mutually parallel.

The ringed part 58 is fitted onto the extended-diameter part 57 of the front wall 26 by touching the front face 28*a* of the thrust plate 28 to the rear face 26*a* of the front wall 26. The front face 28*a* of the thrust plate 28 is formed at the up grade so that the front face is parallel to the front wall 26. Hereby, the rear face 28*b* of the thrust plate 28 is arranged in parallel with the plane perpendicular to the axis 17*a* of the jet pump 17 in a state in which the front face 28*a* of the thrust plate 28 is touched to the rear face 26*a* of the front wall 26.

Further, the front face 55*a* of the stator 55 is formed so that the front is perpendicular to the axis 31*b* of the propeller shaft 31. Therefore, the position of the jet pump 17 is held so that the axis 17*a* is coaxial with the axis 31*b* of the propeller shaft 31 by attaching the front face 55*a* of the stator 55 to the rear face 28*b* of the thrust plate 28.

As described above, the jet pump 17 is fitted to the grade of the propeller shaft 31 by forming the rear face 28*b* of the thrust plate 28 in parallel with the plane perpendicular to the axis 17*a* of the jet pump 17 and can be held in a desired position. Hereby, water jetted from the rear nozzle 36 of the jet pump 17 can be efficiently used as driving force.

A spline 31*a* is formed at the rear end of the propeller shaft 31. Further, a spline 34*b* is formed on a revolving shaft 34*a* on the side of the impeller 34. The propeller shaft 31 is coupled to the revolving shaft 34*a* of the impeller 34 by engaging the spline 31*a* and the spline 34*b*.

Figure 4:
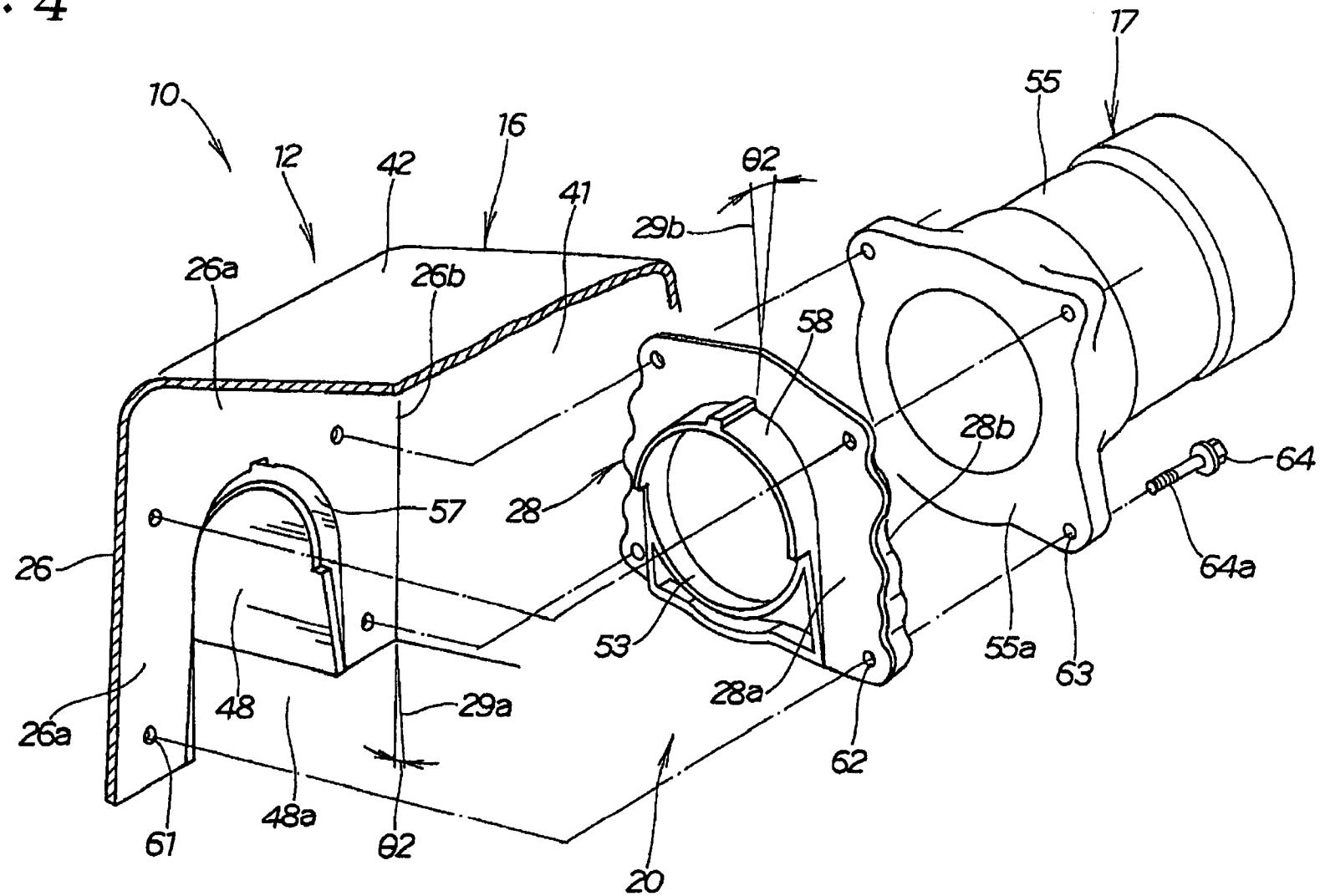
FIG. 4 is an exploded perspective view showing the jet pump mounting structure of the small-sized boat according to the invention.

FIG. 4 is an exploded perspective view showing the jet pump mounting structure of the small-sized boat according to the invention. The thrust plate 28 is formed in a substantially rectangular shape, with the front face 28*a* being inclined by the angle θ2 with the vertical line 29*b* by forming it at the up grade toward the rear of the hull 12, and the thrust plate is formed wedgewise by vertically forming the rear face 28*b*. Mounting holes 62 are formed at four corners of the thrust plate 28.

The ringed part 58 is fitted to the extended-diameter part 57 of the front wall 26 by touching the front face 28*a* of the thrust plate 28 to the rear face 26*a* of the front wall 26. In this state, the front face 55*a* of the stator 55 is touched to the rear face 28*b* of the thrust plate 28.

Bolts 64 are inserted into respective mounting holes 61, 62, 63, of the front wall 26, the thrust plate 28 and the stator 55.

Threaded portions 64*a* of the bolts 64 are protruded from the mounting holes 61 of the front wall 26 and nuts (not shown) are screwed on the protruded threaded portions 64*a*.

Hereby, the jet pump 17 is attached to the front wall 26 via the thrust plate 28 in a state in which the front face 28*a* of the thrust plate 28 is touched to the rear face 26*a* of the front wall 26 and the front face 55*a* of the stator 55 is touched to the rear face 28*b* of the thrust plate 28. In this state, the jet pump 17 is held in a substantially horizontal position (that is, in the position shown in FIG. 2).

Next, referring to FIG. 5, an example in which the hull is injection-molded will be described.

Figure 5A:
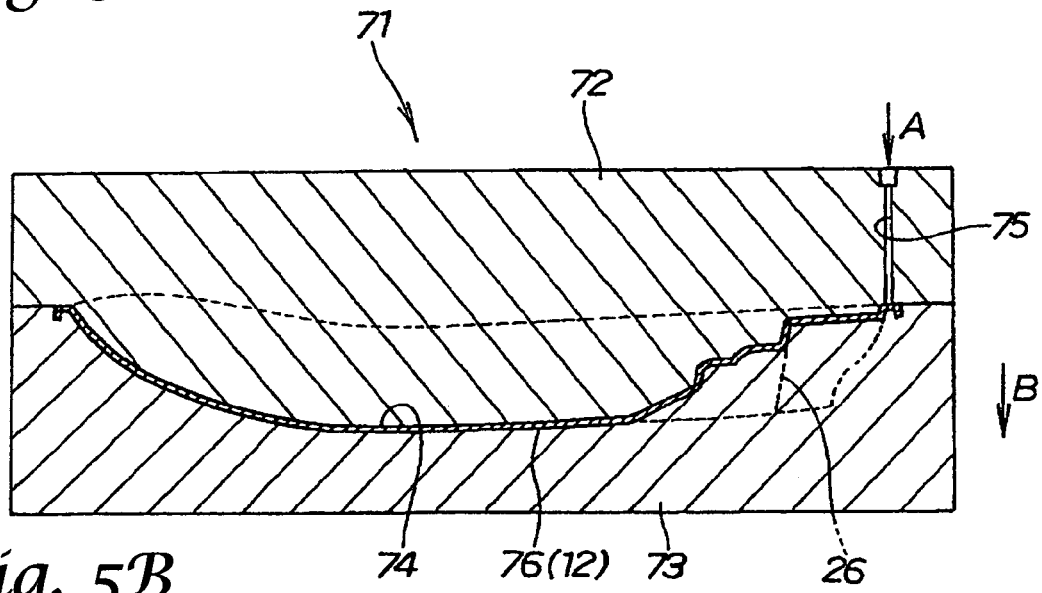
FIGS. 5A and 5B are explanatory drawings for explaining a process in which a hull provided with the jet pump mounting structure according to the invention is molded.
Figure 5B:
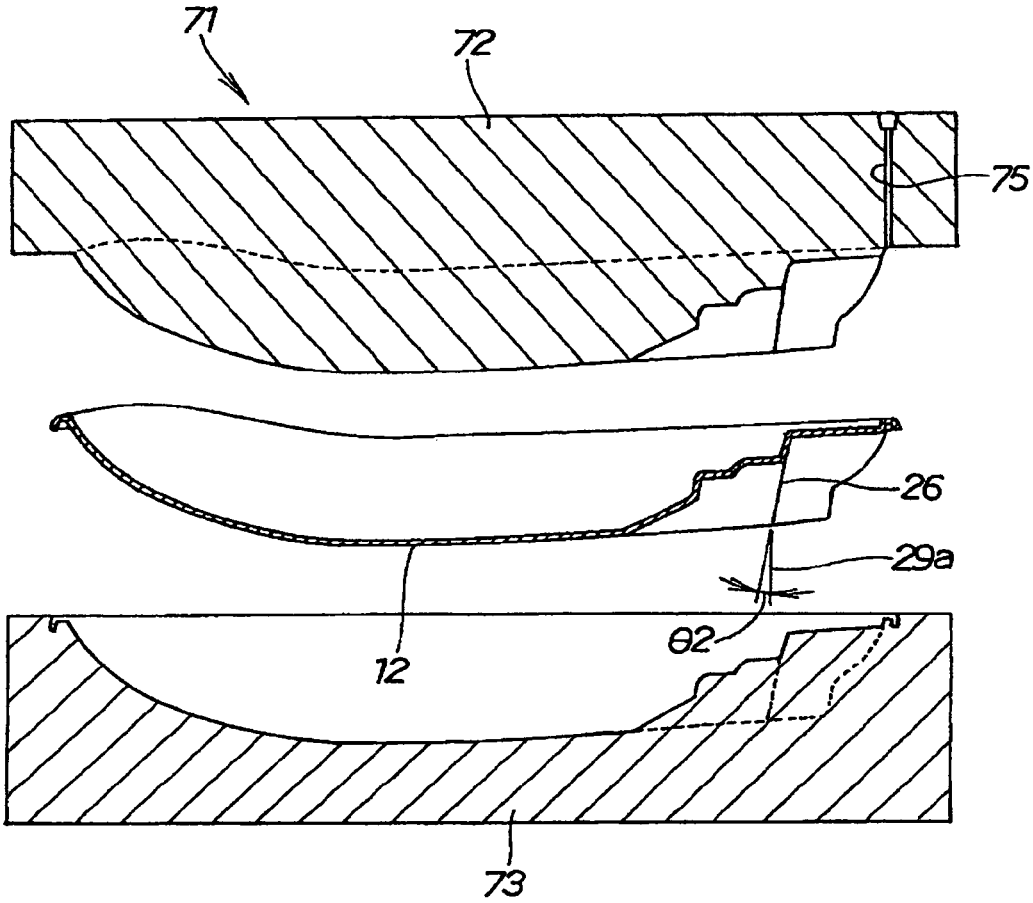
Figure 6:
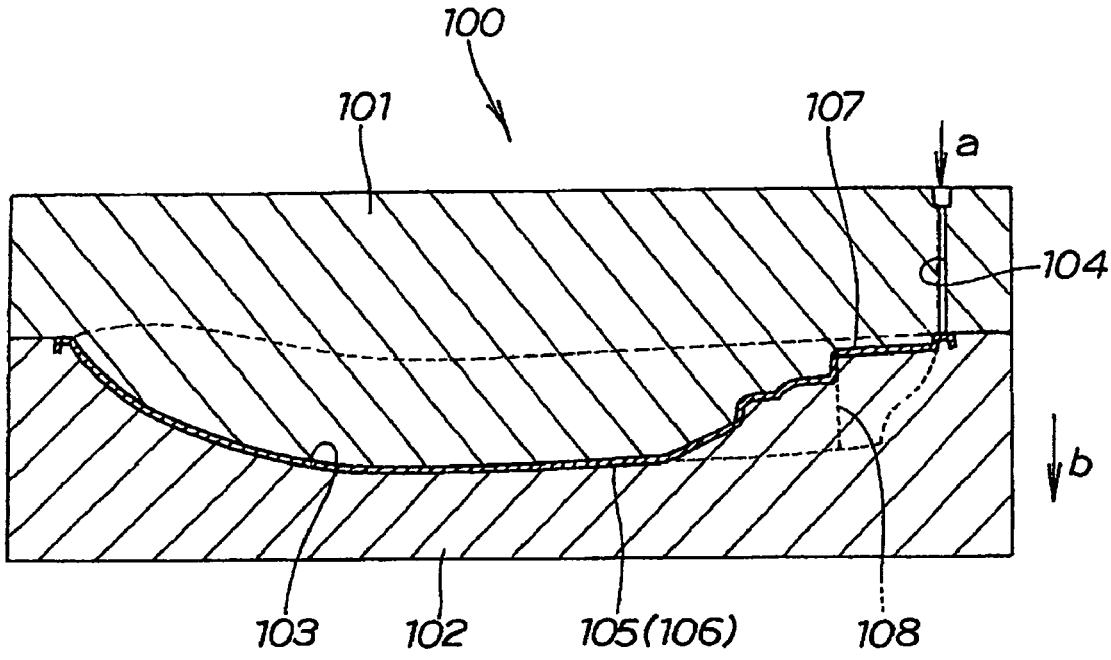
Fig. 6 (PRIOR ART)
FIG. 6 is an explanatory drawing for explaining a conventional type process in which a hull of a small-sized boat is molded.

FIGS. 5A and 5B are explanatory drawings for explaining a process in which the hull provided with the jet pump mounting structure according to the invention is formed.

As shown in FIG. 5A, a fixed mold 72 and a movable mold 73 of a mold 71 are clamped and a cavity 74 is formed. Melted resin 76 is supplied into the cavity 74 via an injection passage 75 from a direction shown by an arrow A. After the melted resin 76 is solidified to be the hull 12, the movable mold 73 is moved in a direction shown by an arrow B and the mold 71 is opened.

As shown in FIG. 5B, the hull 12 is released from the opened mold 71. The front wall 26 is inclined by the angle θ2 with the vertical line 29*a* by forming the front wall 26 of the pump case 16 at the up grade toward the rear of the hull 12.

Therefore, the up grade of the front wall 26 can be utilized as a draft angle when the hull 12 is molded. Hereby, when the hull 12 is molded in the mold 71, the molded hull 12 can be smoothly released from the mold 71 utilizing the draft angle.

In the above-mentioned embodiment, the thrust plate 28 has been described as being formed in a substantially rectangular shape and the mounting holes 62 formed at the four corners. However, the invention is not limited to these examples and another shape, such as a circle, can be also selected.

In addition, the hull 12 and the deck 13 have been described as being molded by injection molding. However, the invention is not limited to this example and the hull 12 and the deck 13 can be molded by other methods, for example in which composite material including resin and reinforcement is sprayed on a mold.

The invention of claimed is:

1. A jet pump mounting structure of a boat comprising:

an engine;

a pump case provided to a rear of a hull forming a lower part of a body of the boat and positioned behind the engine, having:

a front wall, having:

a pump case rear face side facing away from the engine, and wherein the pump case rear face side is at an up grade angle towards the rear of the hull;

a jet pump arranged in the pump case; and a thrust plate having:

a thrust plate front face side, wherein at least a portion of the thrust plate front face side is at an up grade angle and parallel to the pump case rear face side, and at least a portion of the thrust plate front face side is attached to at least a portion of the pump case rear face side, a thrust plate rear face side, wherein the thrust plate rear face side faces away from the pump case rear face side, and wherein at least a portion of the thrust plate rear face side is at an angle parallel with a plane perpendicular to a major axis of the jet pump.

2. The jet pump mounting structure of a boat according to claim 1, wherein:

the engine and the jet pump are coupled by a linear propeller shaft;

the linear propeller shaft is inclined at a down grade angle toward the rear of the hull; and at least a portion of the thrust plate rear face side is on a plane perpendicular to an axis of the linear propeller shaft.

* * * * *